US008049741B2

(12) United States Patent
Knepper et al.

(10) Patent No.: US 8,049,741 B2
(45) Date of Patent: Nov. 1, 2011

(54) VIDEO OPTIMIZED LCD RESPONSE TIME COMPENSATION

(75) Inventors: Lawrence E. Knepper, Austin, TX (US); Randall E. Juenger, Belton, TX (US); Thomas P. Lanzoni, Cedar Park, TX (US)

(73) Assignee: Dell Products L.P., Round Rock, TX (US)

( * ) Notice: Subject to any disclaimer, the term of this patent is extended or adjusted under 35 U.S.C. 154(b) by 1422 days.

(21) Appl. No.: 11/329,927

(22) Filed: Jan. 11, 2006

(65) Prior Publication Data

US 2007/0159425 A1 Jul. 12, 2007

(51) Int. Cl.
*G09G 5/00* (2006.01)

(52) U.S. Cl. ..... 345/204; 345/98

(58) Field of Classification Search ..... 345/204, 345/87, 76, 82, 600
See application file for complete search history.

(56) References Cited

U.S. PATENT DOCUMENTS 4,780,761 A 10/1988 Daly et al. ..... 375/240.2
5,335,016 A 8/1994 Nakagawa ..... 375/240.03
5,581,310 A * 12/1996 Vinekar et al. ..... 348/718
5,614,946 A 3/1997 Fukuoka ..... 348/231.4
5,909,513 A 6/1999 Liang et al. ..... 382/253
6,115,423 A 9/2000 Shen et al. ..... 375/240.03
7,173,640 B2 * 2/2007 Mas et al. ..... 345/694
7,382,349 B1 * 6/2008 Kuhns ..... 345/102
2002/0190940 A1 * 12/2002 Itoh et al. ..... 345/87
2002/0190944 A1 * 12/2002 Morita ..... 345/100
2002/0196243 A1 * 12/2002 Morita ..... 345/204
2005/0151729 A1 * 7/2005 Akimoto et al. ..... 345/204
2005/0200631 A1 * 9/2005 Pan et al. ..... 345/600

* cited by examiner

*Primary Examiner* — Stephen Sherman

(74) *Attorney, Agent, or Firm* — Hamilton & Terrile, LLP; Gary W. Hamilton

(57) ABSTRACT

An improved system and method for selectively applying LCD Response Time Compensation (LRTC) to areas of an LCD panel containing video motion. Motion vectors contained within macroblocks in a compressed video stream are utilized to qualify whether individual pixels in a video frame are a candidate for LRTC. In various embodiments of the invention, computationally expensive LRTC can be selectively applied, pixel-by-pixel, which can result in portable information system power savings by reducing the number of computational cycles and the amount of graphics controller power overhead.

14 Claims, 5 Drawing Sheets

VIDEO OPTIMIZED LCD RESPONSE TIME COMPENSATION

BACKGROUND OF THE INVENTION

1. Field of the Invention

The present invention relates in general to the field of information handling system displays and, more particularly, to a system and method for improving the display of motion video on an LCD panel.

2. Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Information handling systems configured as portable units have grown in popularity among users over the past several years. Portable information handling systems generally integrate in a single housing a display, internal power source and processing components, such as the CPU and hard disk drive, so that a user can carry the portable system from place to place while the system is operating. As processing components have decreased in size and increased in performance, portable information handling systems are often able to pack processing capabilities into a relatively small housing that are comparable to the capabilities available from desktop systems. Generally, the most practical display solution for portable systems both in terms of size and power consumption are liquid crystal display (LCD) panels.

These LCD panels are progressively scanned, meaning that at any given time instant, partial frames of both the previous and current frame are visible on the screen along with a progressively moving tear boundary. This scan and hold characteristic is well suited for the display of static image content, such as spreadsheets and word processing documents, since screen flicker is minimal compared to cathode ray tube (CRT) displays. In the past, video content viewed on LCD panels was generally of low quality and/or resolution, and typically limited to game graphics, Internet video streams, and file-based video clips. Today it is becoming common to use LCD panels for delivery of high quality video content. However, the same characteristics that are well suited for display of static content are undesirable for display of video that contains motion. In general, this is due to the inadequate pixel response times of liquid crystal display (LCD) panels.

Each pixel in an LCD consists of a column of liquid crystal molecules suspended between two transparent electrodes that are in turn sandwiched between two polarizing filters whose axes of polarity are perpendicular to each other. By applying voltage to the transparent electrodes over each pixel, the corresponding liquid crystal molecules are "twisted" by electrostatic forces, allowing varying degrees of light to pass through the polarizing filters. Due to their electro-optical nature, the liquid crystal materials used in LCD panels have inertia and cannot be switched instantaneously. This results in transition response times that are generally not fast enough for high quality video applications. This slow response time, or latency, can result in video motion artifacts that cause quickly moving objects to appear visually blurred, an effect known as "ghosting" or "smearing."

LCD response times continue to improve, but vendor specifications are generally limited to "off-to-on," "rise and fall," or "black-to-white" response time, which is the time it takes a pixel to change from black to white (rise) and then back to black (fall). The voltage required to change an LCD pixel from black to white, or white to black is greater than the voltage to change a pixel from one shade of grey to another. This disparity in voltage differential is the reason "black-to-white" response time is much faster than "grey-to-grey" response time, which is defined as the time it takes a pixel to change from one shade of grey to another. Grey-to-grey response times for LCD panels typically used in portable information handling systems can be many times longer (e.g., 30 to 50 msec.) than corresponding "black-to-white" response times.

Video frame rates are typically on the order of 17 msec at 60 Hz, which can be shorter than liquid crystal "grey-to-grey" response time. These frame rates, when combined with motion within the video frame, can result in video artifacts that cause smearing and low video quality. This problem extends to all LCD displays, but it is more of an issue for LCD panels used in portable information processing systems due to their typically lower power consumption and correspondingly slow response times. In addition, due to limited battery life, power adapter capacity, cooling limitations, fan noise and other operational and design constraints known to those of skill in the art, portable systems are generally designed to efficiently use computation cycles and minimize the associated overhead required to display an image.

Current approaches to pixel response time issues include LCD Response Time Compensation (LRTC), an approach for mitigating video artifacts that can contribute to smearing when motion video is displayed on an LCD screen. LRTC addresses slow intrinsic response times by imposing an extrinsic overdrive voltage for each pixel to be written, based on the prior and next pixel values and the predetermined characteristics of an LCD panel. LRTC has been implemented in LCD-based televisions by applying compensation across the entire screen, based on the assumption that the full screen is displaying motion video. LRTC is also being implemented on computer flat panel monitors, likewise applied across the entire screen, just as it is for LCD-based televisions. However, there is no requirement for LRTC to be applied to an entire screen, as no advantage is gained by applying it to static display areas. In view of the foregoing, there is a need for a system and method for selectively applying LRTC only to those areas of the screen that display video objects in motion.

SUMMARY OF THE INVENTION

The present invention provides an improved system and method for selectively applying LCD Response Time Compensation (LRTC) to areas of an LCD panel containing video motion. Motion vectors contained within macroblocks in a compressed video stream are utilized to qualify whether individual pixels in a video frame are a candidate for LRTC.

In various embodiments of the invention, an incoming compressed video stream is decoded and motion vectors are parsed from each macroblock. The resulting motion vectors are then stored in a tile address generation block. Using video window coordinates, the tile address generation block computes frame buffer screen coordinates for each tile, corresponding to video stream macroblocks with non-zero motion vectors. These tile screen coordinates are then stored in a modified tile table, which is used to identify which pixels which are to be compensated. LRTC can then be selectively applied, pixel-by-pixel, which can result in portable information system power savings by reducing the number of computational cycles and the amount of over power overhead associated with the graphics controller.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

The present invention provides a video optimizer to improve the display of motion video data on an information handling system. As discussed in greater detail below, the video optimizer of the present invention utilizes motion vectors contained within macroblocks in a compressed video stream to selectively apply LCD Response Time Compensation (LRTC) to areas of an LCD panel containing video motion.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

Figure 1:
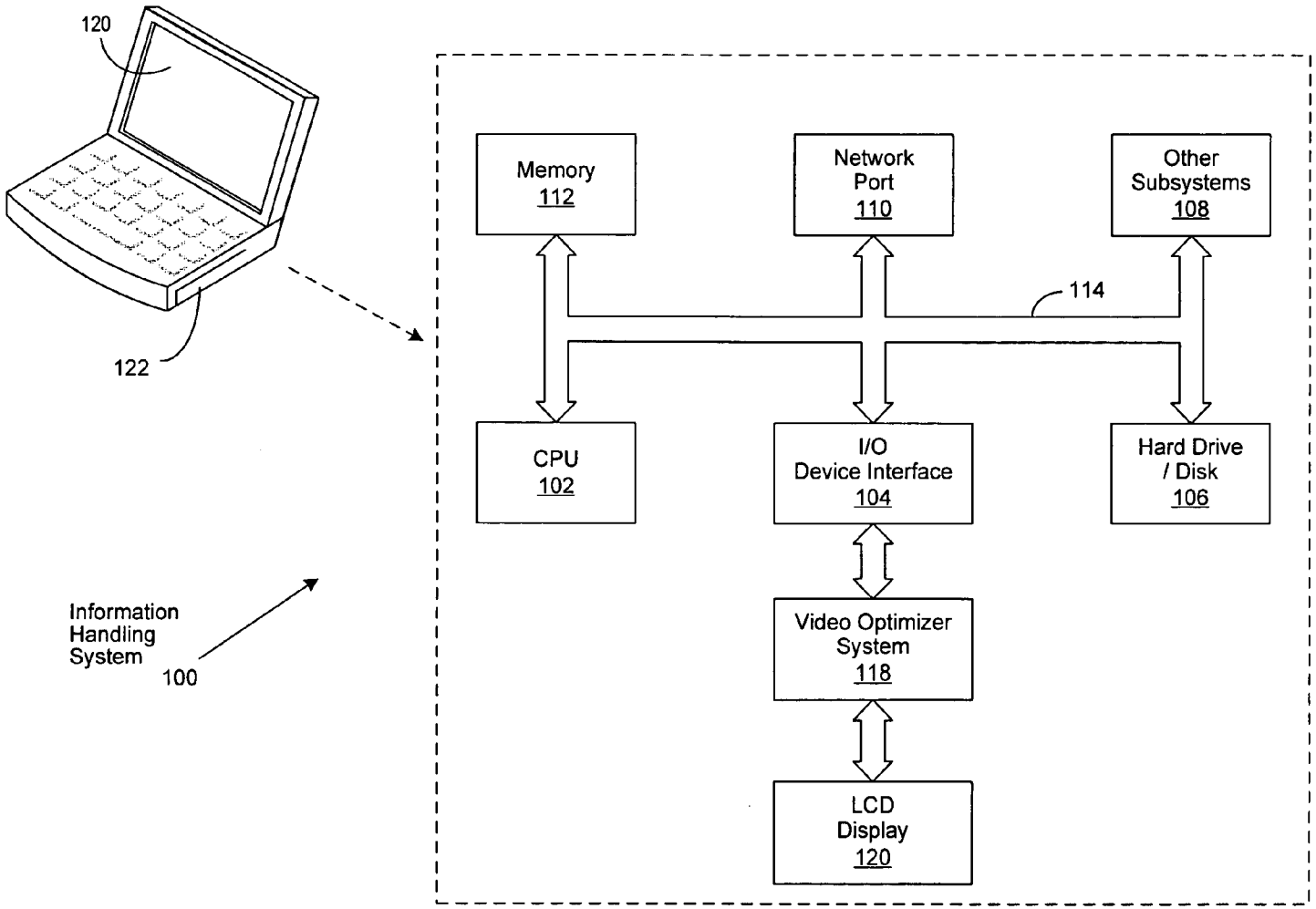
FIG. 1 is a block diagram of a portable information handling system that can be used to implement the method and system of the present invention.

Referring now to FIG. 1, a block diagram depicts an information handling system 100 configured as a portable information processing system having a plurality of processing components, including LCD panel 104, disposed in a housing 122. In various embodiments of the invention discussed below, Video artifacts related to "smearing" or "ghosting" of motion video as displayed on LCD panel 104 can be mitigated while reducing the number of computational cycles and graphics controller power overhead. The functional components of the information handling system include a processor (e.g., central processor unit or "CPU") 102, input/output (I/O) device interface 104, such as a display, a keyboard, a mouse, and associated controllers, a hard drive or disk storage 106, various other subsystems 108, network port 110, and system memory 112. Data is transferred between the various system components via various data buses illustrated generally by bus 114. Video optimizer system 118 couples I/O device interface 104 to LCD display panel 120 as described in greater detail below.

Figure 2:
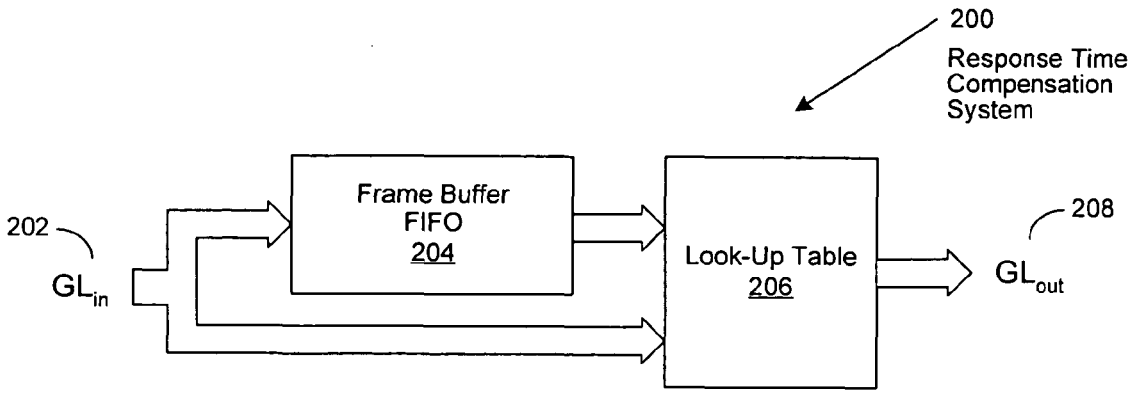
FIG. 2 is a block diagram illustration of a Response Time Compensation (RTC) system as generally implemented in the art.

FIG. 2 is a block diagram illustration of a Response Time Compensation (RTC) system 200 as generally implemented with frame buffer 204 and look-up table (LUT) 206. A digital video stream is intercepted by RTC system 200 and stored in first-in-first-out (FIFO) frame buffer 204. An incoming grey level command (GLin) 202 is compared to the current grey level command and a predetermined alternate grey level is chosen from look-up table (LUT) 206. The chosen grey level value is then issued as outgoing grey level command (GLout) 208, which can be used for response compensation. The compensation can result in either over-driven or under-driven voltages being applied.

Figure 3:
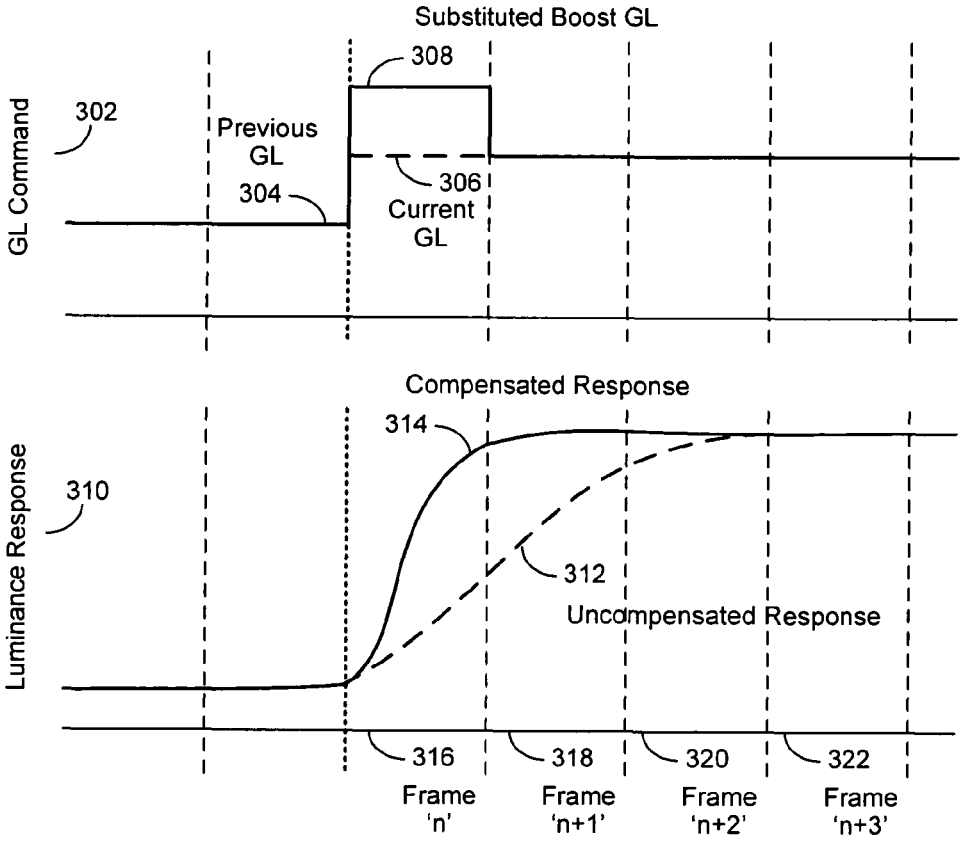
FIG. 3 is a block diagram illustration of the application of an RTC compensation value as generally implemented in the art.

FIG. 3 is a block diagram illustration of the application of an RTC compensation value as generally implemented in the art. An incoming digital video stream comprising grey level commands 302 is processed by RTC system 200 as discussed above. When LUT 206 determines that the previous grey level command 304 is different from current grey level command 306, a predetermined compensation value is applied as substituted grey level boost command 308 to Frame 'n' 316. When the substituted grey level boost command 308 is applied to frame 'n' 316, luminance response 310 results in compensated response 314.

In this illustration, compensated response 314 rises substantively to the desired luminance level within Frame 'n' 316 and reaches stability within Frame 'n+1' 318, whereas uncompensated response 312 rises to the desired luminance level over Frames 'n' 316, 'n+1' 318, and 'n+2' 320 before reaching stability in Frame 'n+3' 322, thereby producing video artifacts resulting in smearing between frames of motion video.

Figure 4:
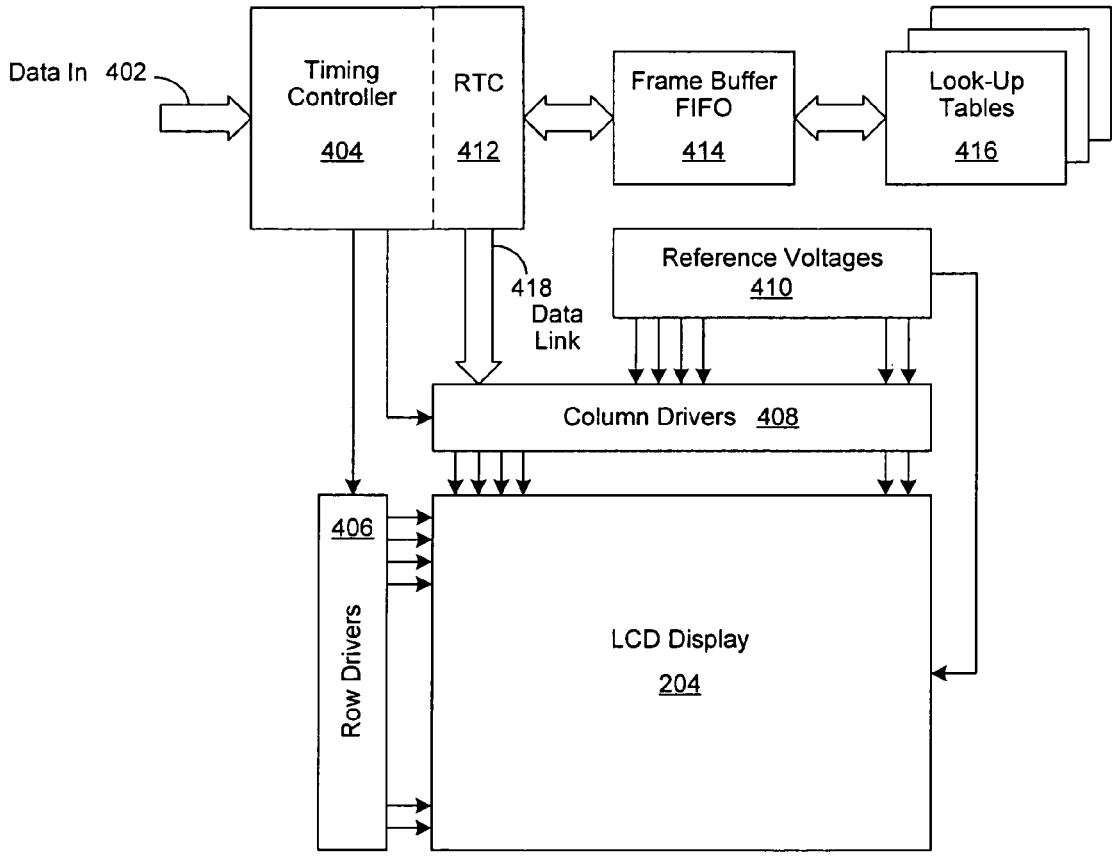
FIG. 4 is a block diagram illustration of an embodiment of an RTC system as generally implemented with a timing controller and LCD display panel.

FIG. 4 is a block diagram illustration of an embodiment of a Response Time Compensation (RTC) system 412 as generally implemented with timing controller 404, FIFO frame buffer 414, and LCD display panel 204. LCD display panel 204 comprises row drivers 406 and column drivers 408. Reference voltages 410 are supplied to column drivers 408 and LCD display panel 204 in a typical resistive-string, digital-to-analog converter (RDAC), column-driven architecture familiar to skilled practitioners of the art.

Timing controller 404 is coupled to row drivers 406 and column drivers 408, which map grey level values to voltage nodes on a series resistance string. Column drivers 408 predetermine the voltage needed at each node to achieve the associated brightness level required to produce the intended grey level value. As grey level commands in digital video stream data 402 are received by timing controller 404, RTC logic 412 retrieves the previous grey level to the corresponding element within the video data stream from FIFO frame buffer 414.

Simultaneously, RTC logic 412 stores the current grey level in FIFO frame buffer 414 for use in the next frame. RTC logic 412 then compares the current and previous grey level commands for each separate red, green and blue (RGB) element using separate RGB look-up tables 416. The contents of RGB look-up tables 416 provide a unique grey level surrogate for each pairing of current and previous grey level commands, which is used to calculate the value of grey level substituted boost 308 as described in more detail above.

Grey level substituted boost 308 commands are communicated by RTC logic 412 through data link 418 to column drivers 408, which then produce an override, or "over-drive" command to deliver appropriate higher voltage to the voltage node. Delivering the higher voltage results in compensated response 314 as described in more detail above, thereby reducing video artifacts that can contribute to smearing of video images containing motion.

Figure 5:
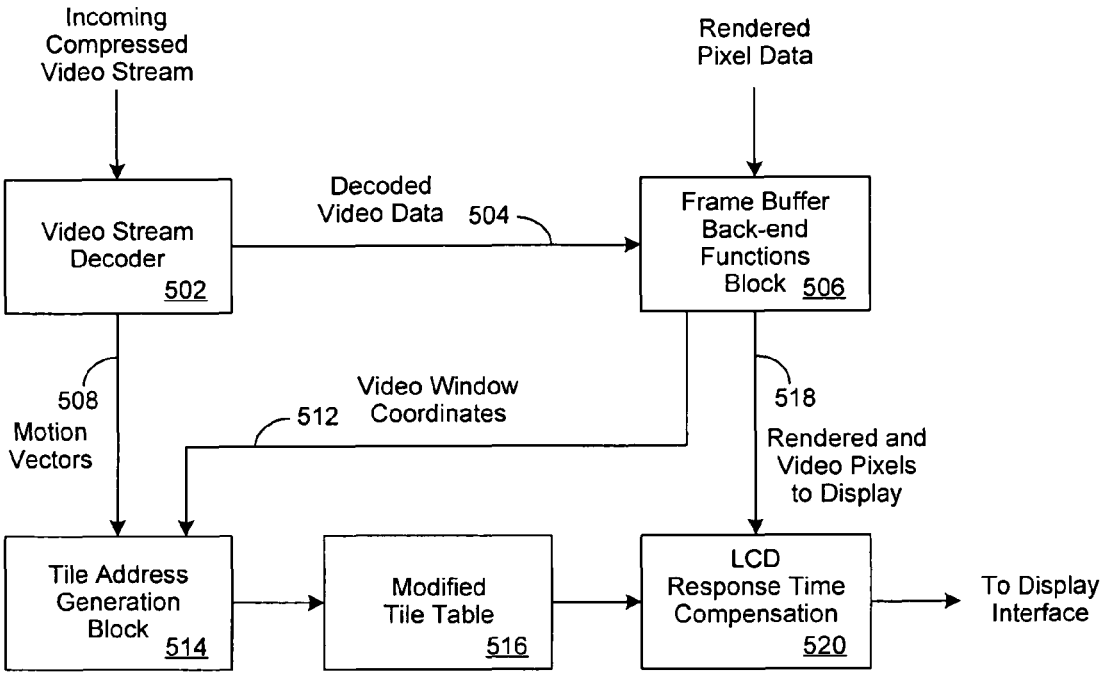
FIG. 5 is a block diagram illustration of an embodiment of the invention.

FIG. 5 is a block diagram illustration of an embodiment of the response time compensation system implemented in the present invention. In this embodiment, an incoming compressed video stream is received by video stream decoder 502 which creates predicted frames (P-frames) and bi-directionally predicted frames (B-frames) by applying motion vectors embedded in each macroblock layer of the compressed video stream through the utilization of video decoding processes understood by skilled practitioners of the art.

Decoded video data 504, in the form of intermediate or reference frames (I-frames), P-frames, and B-frames is forwarded to frame buffer back end functions block 506, which may incorporate rendered pixel data to perform a variety of functions including, but not limited to, scaling the image and/or performing color space conversion. Motion vectors 508 parsed from the incoming compressed video stream are forwarded to tile address generation block 514.

Using video window coordinates 512 from frame buffer backend functions block 506, the tile address generation block 514 computes frame buffer screen coordinates for each tile, corresponding to video stream macroblocks with non-zero motion vectors. These tile screen coordinates are then stored in modified tile table 516, which identifies which screen tiles have been modified. The modified tile table 516 comprises an overlay table wherein a screen pixel correspondence is established that allows LRTC to be applied on a pixel-by-pixel basis "on-the-fly." As rendered video pixels 518 are scanned to the display interface, LCD response time compensation block 520 references information contained in the modified tile table 516 to identify which pixels which are to be compensated.

In an embodiment of the invention, instead of a binary decision based on whether or not motion vectors 508 are non-zero, a threshold could be applied whereby motion greater than that threshold would trigger an entry in modified tile table 516. In another embodiment of the invention, thresholds for the y-component of the motion vector could be different for the x-component (i.e., for anisotropic motion detection).

Figure 6:
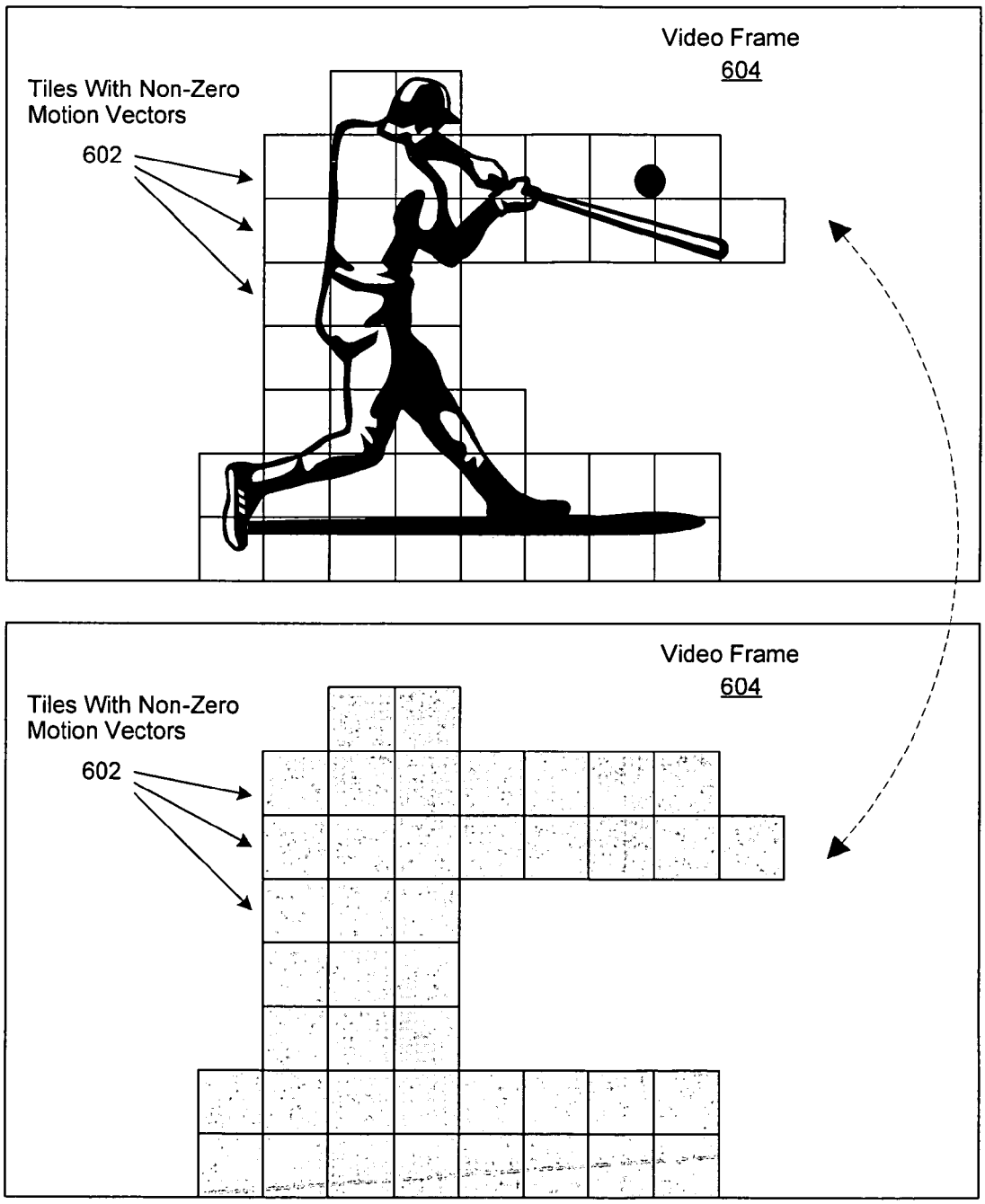
FIG. 6 is a generalized illustration of tiles with non-zero motion vectors in a typical motion video frame.

FIG. 6 is a generalized illustration of an image in a video motion frame 604 comprising a plurality of tiles 602 with non-zero motion vectors. Using the video optimizer of the present invention, the video tiles 602 can be optimized by applying LRTC, while the pixels in the remaining portion of the video frame 604 are powered at standard voltage levels. By selectively using LRTC to enhance the display characteristics of the pixels in the tiles 602 with non-zero motion vectors, an improved video image is provided, while minimizing power consumption.

Although the present invention has been described in detail, it should be understood that various changes, substitutions and alterations can be made hereto without departing from the spirit and scope of the invention as defined by the appended claims.

What is claimed is:

1. An information handling system comprising:

data processing components configured to process a compressed stream of video data comprising a plurality of macroblocks;

control logic configured to:

process said compressed stream of video data to generate decoded video data and to detect one or more non-zero motion vectors contained in an individual macroblock of said plurality of macroblocks;

perform parsing operations to parse said one or more non-zero motion vectors from said individual macroblock;

provide said one or more non-zero motion vectors to a tile address generation block;

process video window coordinates to generate frame buffer screen coordinates for a plurality of tiles corresponding to said individual macroblock, the tile address generation block using video window coordinates to perform said processing;

store said frame buffer screen coordinates in a modified tile table;

apply liquid crystal response time compensation (LRTC) to a plurality of pixels corresponding to said plurality of tiles to generate compensated video data;

process said decoded video data and said compensated video data to generate processed video data; and a display operable to display said processed video data.

2. The information handling system of claim 1, wherein said control logic comprises liquid crystal response time compensation (LRTC) circuitry.

3. The information handling system of claim 2, wherein said LRTC is operable to optimize performance of frame buffer tiles corresponding to said plurality of pixels.

4. The information handling system of claim 1, wherein said control logic comprises a video decoder configured to process said macroblocks to obtain predicted frames of pixels within said plurality of pixels corresponding to said one or more motion vectors.

5. The information handling system of claim 4, wherein said video decoder is further configured to process said macroblocks to obtain bidirectional predicted frames of pixels within said plurality of pixels corresponding to said one or more motion vectors.

6. A method for optimizing performance of an information handling system display, comprising:

using data processing components configured to process a compressed stream of video data comprising a plurality of macroblocks;

using control logic to:

perform parsing operations to parse said one or more non-zero motion vectors from said individual macroblock;

provide said one or more non-zero motion vectors to a tile address generation block;

process video window coordinates to generate frame buffer screen coordinates for a plurality of tiles corresponding to said individual macroblock, the tile address generation block using video window coordinates to perform said processing;

store said frame buffer screen coordinates in a modified tile table;

apply liquid crystal response time compensation (LRTC) to a plurality of pixels corresponding to said plurality of tiles to generate compensated video data;

process said decoded video data and said compensated video data to generate processed video data; and using a display operable to display said processed video data.

7. The method of claim 6, wherein said control logic comprises liquid crystal response time compensation (LRTC) circuitry.

8. The method of claim 7, wherein said LRTC is operable to optimize performance of frame buffer tiles corresponding to said plurality of pixels.

9. The method of claim 6, wherein said control logic comprises a video decoder configured to process said macroblocks to obtain predicted frames of pixels within said plurality of pixels corresponding to said one or more motion vectors.

10. The method of claim 9, wherein said video decoder is further configured to process said macroblocks to obtain bidirectional predicted frames of pixels within said plurality of pixels corresponding to said one or more motion vectors.

11. A system for displaying video data, comprising:

control logic configured to:

process said compressed stream of video data to generate decoded video data and to detect one or more non-zero motion vectors contained in an individual macroblock of said plurality of macroblocks;

perform parsing operations to parse said one or more non-zero motion vectors from said individual macroblock;

provide said one or more non-zero motion vectors to a tile address generation block;

process video window coordinates to generate frame buffer screen coordinates for a plurality of tiles corresponding to said individual macroblock, the tile address generation block using video window coordinates to perform said processing;

store said frame buffer screen coordinates in a modified tile table;

apply liquid crystal response time compensation (LRTC) to a plurality of pixels corresponding to said plurality of tiles to generate compensated video data;

process said decoded video data and said compensated video data to generate processed video data; and a display operable to display said processed video data.

12. The system of claim 11, wherein said control logic comprises liquid crystal response time compensation (LRTC) circuitry.

13. The system of claim 12, wherein said LRTC is operable to optimize performance of frame buffer tiles corresponding to said plurality of pixels.

14. The system of claim 11, wherein said control logic comprises a video decoder configured to process said macroblocks to obtain predicted frames of pixels within said plurality of pixels corresponding to said one or more motion vectors.

* * * * *